United States Patent [19]

Nishida et al.

[11] Patent Number: 4,924,149

[45] Date of Patent: May 8, 1990

[54] APPARATUS FOR CONTROLLING THE CHARGING OF A MAIN CAPACITOR OF A FLASH UNIT

[75] Inventors: Takao Nishida, Saitama; Takeo Kobayashi, Tokyo, both of Japan

[73] Assignee: Asahi Kogaku Kogyo Kabushiki Kaisha, Tokyo, Japan

[21] Appl. No.: 137,329

[22] Filed: Dec. 23, 1987

[30] Foreign Application Priority Data

Dec. 23, 1987 [JP] Japan ..... 61-307478

[51] Int. Cl.[5] ..... H05B 37/00

[52] U.S. Cl. ..... 315/241 P; 315/241 S; 315/209 F; 315/DIG. 5; 315/DIG. 4; 315/241 R; 315/307; 354/127.1; 354/127.11

[58] Field of Search ..... 315/241 P, 219 R, 241 S, 315/DIG. 5, DIG. 4, 241 R, 307; 354/127.1, 127.11, 127.13

[56] References Cited

U.S. PATENT DOCUMENTS

| | | | |
|---|---|---|---|
| 3,777,212 | 12/1973 | Mashino | 315/241 R |
| 3,780,344 | 12/1973 | Paget | 315/241 R |
| 4,005,337 | 1/1977 | Rabe | 315/241 R |
| 4,013,921 | 3/1977 | Corthell | 315/241 R |
| 4,384,776 | 5/1983 | Takami | 354/127 |
| 4,422,016 | 12/1983 | Kurple | 315/241 S |
| 4,540,265 | 9/1985 | Harvey | 315/241 P |
| 4,623,824 | 11/1986 | Scolari et al. | 315/241 R |
| 4,628,229 | 12/1986 | Inoue | 315/241 P |

*Primary Examiner*—Leo H. Boudreau
*Assistant Examiner*—Michael Razavi
*Attorney, Agent, or Firm*—Sandler, Greenblum & Bernstein

[57] ABSTRACT

An apparatus is provided for controlling the charging of a main capacitor of a flash unit. Comparison means detect the timing at which a voltage V across the main capacitor reaches a reference voltage $V_1$, at which point a flash photograph can be taken. A timer detects whether a predetermined time period has elapsed since the voltage V across the main capacitor reached the reference voltage $V_1$ so as to stop charging the main capacitor. When the voltage V across the main capacitor drops to the reference voltage $V_1$, as a result of the phenomenon known as "spontaneous discharge", recharging of the main capacitor occurs and the above process is repeated. When the recharging of the main capacitor has been performed over a predetermined time period or a predetermined number of times, the charging of the main capacitor is stopped. A second embodiment is disclosed wherein flash photography can occur if a predetermined value is greater than the time period that has elapsed until a shutter on a camera associated with the flash unit is operated after the voltage V across the main capacitor has reached a reference voltage $V_2$ (which is greater than $V_1$). If the time period is less than the predetermined value, the operation of the flash unit is inhibited so as to restart the charging of the main capacitor.

2 Claims, 11 Drawing Sheets

APPARATUS FOR CONTROLLING THE CHARGING OF A MAIN CAPACITOR OF A FLASH UNIT

BACKGROUND OF THE INVENTION

1. Field of the Invention

The present invention relates to a camera having a built-in flash which is provided with CPUs and, more particularly, to an apparatus for providing ON-OFF control over the charging of a main capacitor of a flash unit built in a photographic camera. Such a flash unit is disclosed, for example, in U.S. patent application No. 934,055 now U.S. Pat. No. 4,893,140.

2. Description of the Prior Art

In general, modern photographic cameras are remarkably automated and are provided with a multiplicity of functions. It is common practice to incorporate a plurality of one-chip microcomputers (hereinafter referred to as "CPU" or "CPUs") in a single photographic camera. In the field of built-in flash cameras, it is particularly desirable to minimize the number of parts.

A conventional type of apparatus for controlling the charging of a main capacitor of a flash unit is arranged to detect in two steps the fact that a voltage V developed across the main capacitor has reached the level of a reference voltage. That is to say, when $V > V_1$, a neon glow lamp is turned on and flash photography is enabled and, when $V = V_2$ ($V_2 > V_1$), charging is stopped. After one cycle of flash photography has been completed, the aforesaid operation is again performed.

However, since the voltage V developed across the main capacitor is detected in two steps, it is necessary to incorporate two voltage comparing circuits and therefore the number of parts must be increased.

As the remaining capacity of the batteries drops, the time period taken until the level of the voltage V across the main capacitor reaches the level of a predetermined reference voltage $V_2$ is excessively extended and therefore the power consumption of a DC/DC converter and other circuits also increases. As a result, the number of flashes is reduced.

There are some instances where, after the stop of charging, photographs are taken at intervals which are equal to or longer than the elapsed time period until the level of the voltage V across the main capacitor reaches the level of the reference voltage $V_1$ as the result of spontaneous discharge, (hereinafter referred to as "spontaneous-discharge period"). For example, an animal which is moving past a predetermined position at night may need to be automatically detected and photographed. In this case, however, it has been impossible to take flash photographs and therefore built-in flash cameras are not suitable for use in photography under these conditions.

SUMMARY OF THE INVENTION

It is therefore an object of the present invention to provide an apparatus for controlling the charging of a main capacitor of a flash unit in which the number of parts can be reduced but the number of flashes can be increased.

It is another object of the present invention to provide an apparatus for controlling the charging of a main capacitor of a flash unit wherein, in spite of the reduced number of parts, flash photographs can be taken even at intervals which are not shorter than the spontaneous discharge period of the main capacitor.

In accordance with the first aspect of the present invention, there is provided an apparatus for controlling the charging of a main capacitor of a flash unit as shown in FIG. 1A, which employs a single comparison means to detect the fact that the voltage V across a main capacitor $C_M$ has reached the reference voltage $V_1$ at which flash photographs can be taken, and then to employ a timer to detect the fact that a predetermined time period has elapsed after such detection so that the charging of the main capacitor $C_M$ is stopped. In this arrangement, the comparison means is one in number and the CPU is provided with a timer function as a portion of the processing program executed by the CPU. It is accordingly possible to provide the following advantages: a reduction in the number of parts, a reduction in the size of a printed circuit board to be incorporated in a camera, a lowering in the failure rate of the camera, and a reduction in the cost of production. In addition, even in a case where, because of a drop in the remaining capacity of the batteries, a long time period is required until the voltage V across the main capacitor $C_M$ *reaches the predetermined voltage* $V_2$ which is higher than the reference voltage $V_1$, the timer is used to detect the passage of a predetermined time period so as to stop charging. Accordingly, it is also possible to provide the advantage of a reduction in power consumption and hence an increase in the number of flashes.

In accordance with the second aspect of the present invention, there is provided an apparatus for controlling the charging of a main capacitor of a flash unit which is arranged, as shown in FIG. 1B, to employ comparison means to detect the fact that the level of the voltage V across the main capacitor $C_M$ has reached the level of the reference voltage $V_1$ and to perform recharging when the level of the voltage V drops to the level of the reference voltage $V_1$ as a result of the spontaneous discharge after completion of charging. Accordingly, in addition to the advantage achieved in the first aspect of the present invention, there is another advantage in that flash photographs can be taken by means of a simple construction at intervals which are not shorter than the spontaneous-discharge period, without the need for a complicated operation in which initialization must be performed by turning on a flash switch after being turned off once.

Moreover, in accordance with a third aspect of the present invention, there is provided an apparatus for controlling the charging of a main capacitor of a flash unit which is arranged, as shown in FIG. 1C, to permit flash photography if the time period required until the ensuing shutter release, after the voltage V across the main capacitor $C_M$ has reached the reference voltage $V_2$ ($>V_1$) at which flash photographs can be taken, is less than a predetermined value, and to inhibit flash photography to restart the charging of the main capacitor $C_M$ if the aforesaid time period is not less than the predetermined value. It is therefore possible to accomplish the advantages achieved in the first and second aspects of the invention. In this case, the reason why the number of flashes increases is that it is possible to prevent charging and discharging from being repeated many times.

DESCRIPTION OF THE PREFERRED EMBODIMENTS

Preferred embodiments of the present invention will be described below with reference to the accompanying drawings.

EMBODIMENT OF THE FIRST ASPECT OF THE INVENTION

The following is a detailed description of a preferred embodiment of a first aspect of the present invention.

Figure 1A:
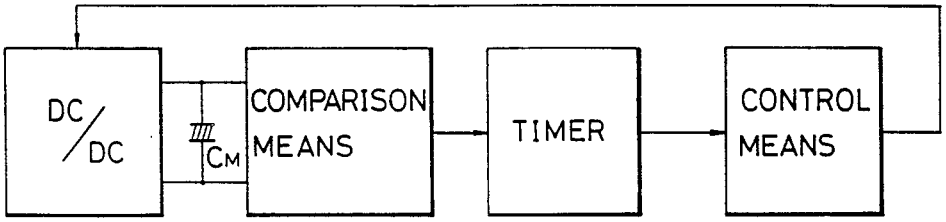
FIG. 1A is a block diagram illustrating the construction of a first aspect of the present invention.
Figure 1B:
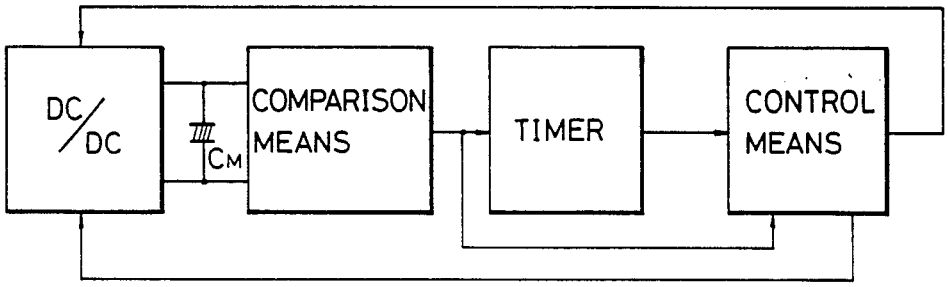
FIG. 1B is a block diagram illustrating the construction of a second aspect of the present invention.
Figure 1C:
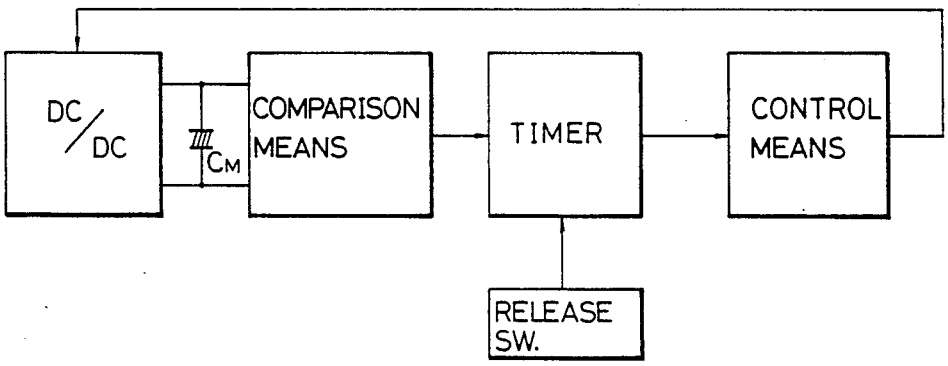
FIG. 1C is a block diagram illustrating the construction of a third aspect of the preferred invention.
Figure 2:
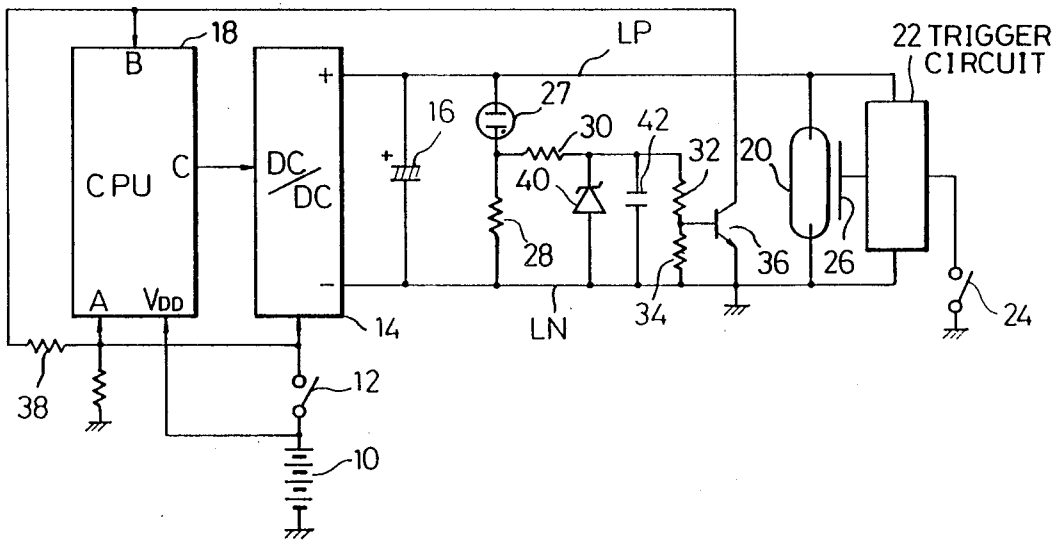
FIG. 2 is a circuit diagram of the electronic flash circuit of a preferred embodiment of the invention in accordance with the first aspect thereof.

FIG. 2 is a circuit diagram illustrating the electronic flash circuit incorporated in a photographic camera disclosed in U.S. patent application No. 934,055.

The terminal voltage of a series of batteries 10 is applied to a DC/DC converter 14 through a flash switch 12 and, after being boosted, this applied voltage is stored as an electric charge in a main capacitor 16. An oscillation circuit which constitutes the DC/DC converter 14 is turned on and off by a control signal output from an output terminal C of a CPU 18, thereby providing control over the starting and stopping of the charging of the main capacitor 16.

The CPU 18 is actuated by the direct application of the terminal voltage of the batteries 10. An input terminal A of the CPU 18 is connected to a battery voltage input terminal of the DC/DC converter 14. Thus the CPU 18 is capable of detecting the opening and closing of the flash switch 12.

Buses LP and LN are connected to the voltage output terminals of the DC/DC converter 14.

A xenon discharge tube 20 and a trigger circuit 22 are connected in parallel between the buses LP and LN. When a flash sync contact 24 is closed in a state wherein the level of the voltage V developed across the main capacitor 16 is equal to or higher than the level of the reference voltage $V_1$, a high voltage is applied to a trigger electrode 26 to cause a discharge to take place, thereby causing the xenon discharge tube 20 to flash.

A neon glow lamp 27 and a resistor 28 are connected in series between the buses LP and LN. When the voltage V developed across the main capacitor 16 reaches the aforesaid reference voltage $V_1$, the neon glow lamp 27 is turned on.

Voltage dividing resistors 30, 32 and 34 are connected in series between the bus LN and the junction of the neon glow lamp 27 and the resistor 28. The base of an NPN transistor 36 is connected to the junction of the voltage dividing resistors 32 and 34. The emitter of the NPN transistor 36 is connected to the bus LN while the collector is connected to the positive pole of the batteries 10 via the flash switch 12.

The collector of the NPN transistor 36 is also connected to an input terminal B of the CPU 18. When the neon glow lamp 27 is OFF ($V<V_1$), the NPN transistor 36 is held in its OFF state and the potential at the input terminal B is held at a high level. When the neon glow lamp 27 is turned on ($V \geqq V_1$), the NPN transistor 36 is turned on and the potential at the input terminal B goes to a low level. Accordingly, the CPU 18 can utilize such variations in the potential at the input terminal B to detect a point in time at which the level of the voltage V momentarily coincides with the level of the reference voltage $V_1$.

A zener diode 40 and a capacitor 42 are connected in parallel between the bus LN and the junction of the voltage dividing resistors 30 and 32. The zener diode 40 is provided for voltage clipping and the capacitor 42 is provided for noise elimination.

Figure 8:
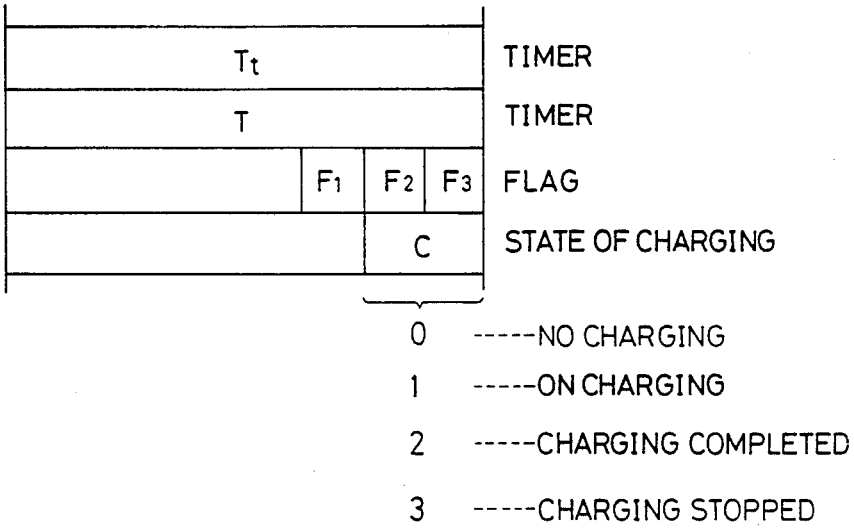
FIG. 8 is a timing chart illustrating the voltage V across the main capacitor in comparison with variations in a flag F.
Figure 9:
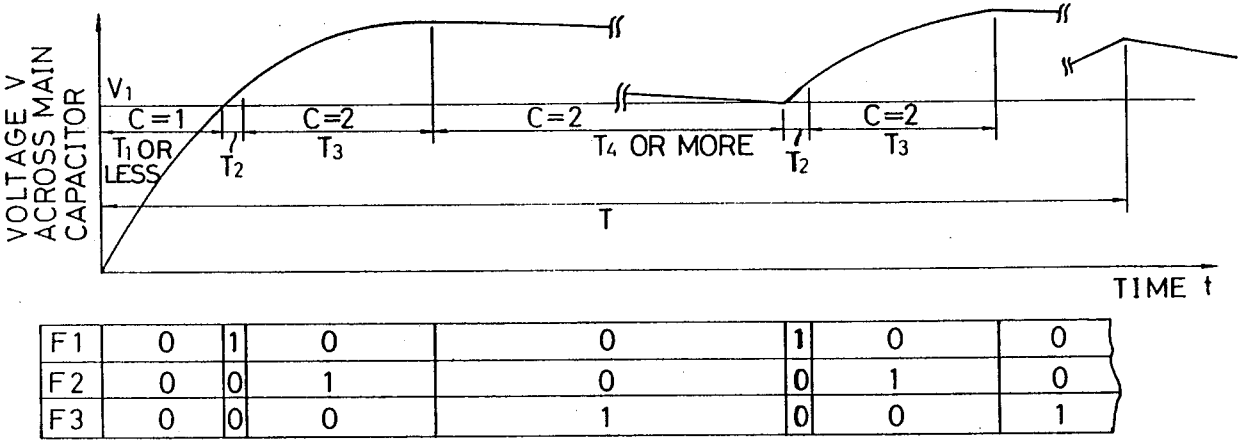
FIG. 9 is a schematic illustration of a portion of the storage area of the RAM of the CPU shown in FIG. 2.

The CPU 18 is a one-chip microcomputer provided with a timer function, and a timer interrupt takes place at predetermined intervals of, for example, 30 milliseconds. As illustratively shown in FIG. 8, the values of timers T and $T_t$ which correspond to predetermined addresses of the RAM of the CPU 18 are incremented each time a timer interrupt occurs (the timer $T_t$ is used in an embodiment of the second aspect of the invention which will be described later). In FIG. 8, flags $F_1$, $F_2$ and $F_3$ (the flag $F_3$ is used in an embodiment of the second aspect of the invention which will be described later) represent a time period during which the main capacitor 16 is being charged, and each of the flags $F_1$, $F_2$ and $F_3$ varies, as shown in FIG. 9. FIG. 9 illustrates a preferred embodiment of the second aspect of the invention. In the present embodiment, charging and discharging are not repeated. The CPU 18 is adapted to write a state of charging C into a predetermined address of its RAM, and a main CPU (not shown) controls the entire circuit, causing an interrupt to occur in the CPU 18. At the time of such an interrupt, the main CPU reads out the state of charging C through a data transfer and, only when charging is completed (C=2), does the main CPU provides control over flash photography.

The flow of the program written in the ROM of the CPU 18 will be described below with reference to FIG. 3. This program is executed each time a timer interrupt for incrementing the timer T occurs. Also, in an initialized state, that is, when the flash switch 12 is open, a command indicative of the charging is output from an output terminal C of the CPU 18. Therefore, immediately after the flash switch 12 has been closed, charging is started.

When the flash switch 12 is open, the process proceeds from Step 100 to Step 102, in which the value of the timer T is cleared and the flags $F_1$ and $F_2$ are reset.

Then, in Step 103, the value representative of the state of charging C is reset to "0" (no charging), and the process returns to the routine which was executed immediately before this interrupt.

When the flash switch 12 is closed, the process proceeds from Step 100 to Step 104, in which judgement is made as to whether or not the potential at the input terminal B has dropped to a predetermined level. Initially, the process proceeds to Steps 106 to 112 since a negative judgement is made in Step 104 because $V<V_1$ and because the flags $F_1$ and $F_2$ are reset in Step 102. In Step 112, it is normally judged that $T<T_1$, and the process proceeds to Step 114. In Step 114, after the value of the state of charging C has been set to "1" (on charge), the process returns to the processing that was executed immediately before this interrupt. The time period $T_1$ is, for example, 30 seconds, and is allocated to allow the judgement to be made as to whether or not the battery is dead.

When the potential at the input terminal B rises to the predetermined level within the time period $T_1$ after the flash switch 12 has been turned on, the process proceeds from Step 104 to Step 116 in which the value of the timer T is cleared and flag $F_1$ is set to "1".

In the next interrupt, the process proceeds from Step 104 through Step 106 to Step 118 in which the value of the timer T is compared with the value of the time period $T_2$. The value of the time period $T_2$ is, for example, 0.5 seconds and, if $T<T_2$, the process returns to the processing that was executed immediately before this interrupt. If the level of the voltage V developed across the main capacitor 16 becomes $V<V_1$ as the result of the spontaneous discharge thereof, flash photography may become impossible within a short time between the moment at which the charging is stopped by turning on a release switch and the point at which the emission of flash light is started. The time period $T_2$ is used as a waiting time period allocated to allow prevention of occurrence of such a phenomenon.

If it is judged in Step 118 that $T=T_2$, the process proceeds to Step 120 in which the value of the timer T is cleared and the flag $F_1$ is reset with the flag $F_2$ being set. In the following Step 122, the value of the state of charging C is set to "2" (charging completed), and the process returns to the processing that was executed immediately before this interrupt.

In the following interrupt, the process proceeds from Step 104 through Steps 106 and 108 to Step 124 in which the value given by the timer T is compared with a time period $T_3$ The time period $T_3$ is, for example, 16 seconds, and is allocated to allow judgement to be made as to whether or not charging should be stopped. If $T<T_3$, the process returns to the processing which was executed immediately before this interrupt. If it is judged in Step 124 that $T=T_3$, the process proceeds to Step 126 in which the CPU 18 supplies a control signal to the DC/DC converter 14 to stop the oscillation circuit, thereby stopping the charging of the main capacitor 16. Then, in Step 128, the timer interrupt is inhibited, and the process returns to the processing which was executed immediately before this interrupt. After the flash switch 12 has been turned off once by this inhibition of the timer interrupt, the processing shown in FIG. 3 is not executed again until the flash switch 12 is turned on once more.

In this state, if the flash sync contact 24 is turned on, an interrupt routine (not shown) is executed so that $C=0$ is set, the flags $F_1$ and $F_2$ being reset, the timer T being cleared, and the timer interrupt being enabled. Accordingly, when a flash photograph is taken, the aforesaid processing is restarted.

In a case where it is in Step 112 that $T=T_1$, that is, in a case where $V=V_1$ is not obtained even after the time period $T_1$ has elapsed following the ON operation of the flash switch 12, the process proceeds to Step 138 in which the value of the state of charging is set to $C=3$ (representative of the fact that use of the flash unit has ceased). Then, in Step 140, the timer interrupt is inhibited, and the process returns to the processing which was executed immediately before this interrupt.

EMBODIMENT OF THE SECOND ASPECT OF THE INVENTION

The following is a description of a preferred embodiment of the second aspect of the invention.

The hardware arrangement in this embodiment is the same as that of the embodiment of the first aspect of the invention. As shown in FIG. 4, in the software arrangement of this embodiment, Steps 102A, 104A, and 128A are substituted for Steps 102, 104 and 128 illustrated in FIG. 3, and also Steps 110 and 130 to 136 are added.

More specifically, a new flag $F_3$ is added, and in Step 102A the flag $F_3$ is reset. In addition, in Step 104A, when the potential at the input terminal B drops to the predetermined level and the flag $F_3$ is "0", the process proceeds to Step 116. If not, the process proceeds to Step 106. In Step 128A, the value of the timer T is cleared, the flag $F_2$ is reset, and the flag $F_3$ is set. Then, the process returns to the process which was executed immediately before this interrupt.

In the next interrupt, the process proceeds from Step 104A through Steps 106, 108 and 110 to Step 130 in which judgement is made as to whether the potential at the input terminal B has risen to the predetermined level. If a negative judgement is made in Step 130, the process returns to the processing that was executed immediately before this interrupt. When the level of the voltage V across the main capacitor 16 drops to the level of the reference voltage $V_1$, as the result of the spontaneous discharge thereof, affirmative judgement is made in Step 130, and the process proceeds to Step 132 in which the value of the timer T is compared with the value of a time period $T_4$. The time period $T_4$ is allocated to allow a judgement to be made as to whether or not the batteries are dead. If $T>T_4$, the process proceeds to Step 134 in which the CPU 18 supplies a control signal to the DC/DC converter 14 to activate the oscillation circuit and cause it to restart the charging of the main capacitor 16. Then, in Step 136, the flag $F_3$ is reset and the state of charging C is set to $C=1$ (on charge), and the process returns to the processing which was executed immediately before this interrupt.

In the following interrupt, the process proceeds from Step 104A to Step 116 and subsequently the above-mentioned processing is repeated.

In this manner, as shown in FIG. 9, when time period $T_2$ has elapsed, after $V=V_1$ has been achieved following the starting of charging, charging is completed and flash photography becomes possible. Thereafter, when $V=V_1$ is again achieved as the result of the spontaneous discharge, charging is resumed and the above-described processing is repeated.

If it is judged in Step 112 that $T=T_1$ or if it is judged in Step 132 that $T\leqq T_4$, that is, if $V=V_1$ is not achieved when the time period $T_1$ has elapsed after the flash switch 12 has been turned on or if the level of the voltage V across the DC/DC converter 16 hardly rises and thus drops to the level of $V=V_1$ within the time $T_4$ following the stop of charging, the process proceeds to Step 138 in which the state of charging C is set to C=3 (the fact that use of any flash unit has ceased). Then, in Step 140, the timer interrupt is inhibited, and the process returns to the processing which was executed immediately before this interrupt.

Accordingly, this preferred embodiment provides the effect that enables a simple construction to be used to detect the dead state of the batteries even during the repetition of charging and discharging.

In this case, if the flash sync contact 24 is turned on, an interrupt routine (not shown) is used to set the state of charging C to C=0 (no charging), reset the flags $F_1$ to $F_3$, and clear the timer T.

SECOND EMBODIMENT OF THE SECOND ASPECT OF THE INVENTION

The following is a description of a second embodiment of the second aspect of the invention.

Figure 5:
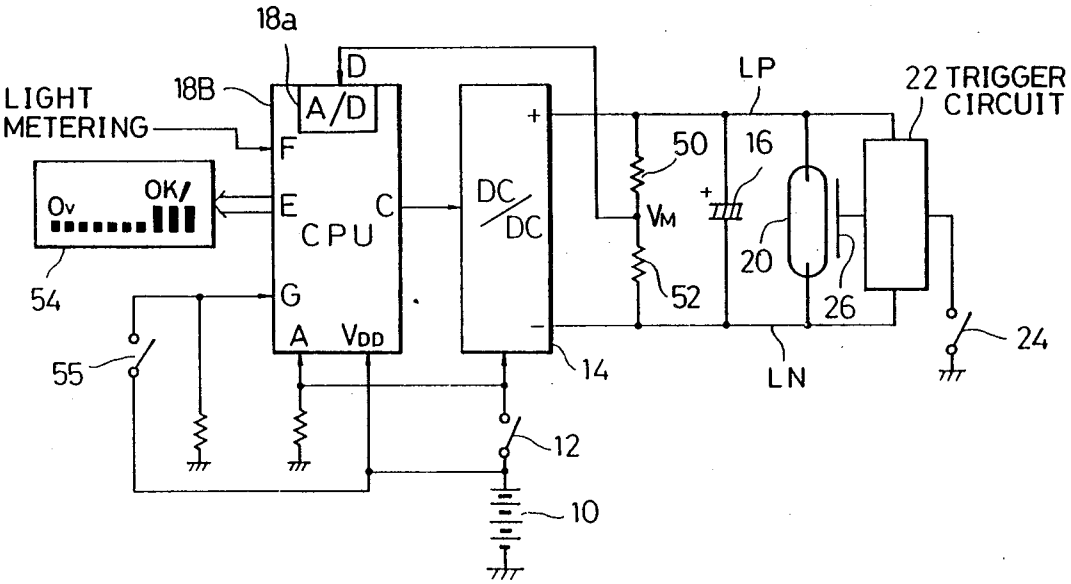
FIG. 5 is a circuit diagram of the electronic flash circuit of a second embodiment of the invention in accordance with the second aspect thereof.

The hardware arrangement of this embodiment is as shown in FIG. 5.

This embodiment does not include elements 27, 28, 30, 32, 34, 36, 38, 40 or 24 which are illustrated in FIG. 2. Instead, a CPU 18A includes an A/D converter 18*a* and an LCD driver. Voltage dividing resistors 50 and 52 are connected in series between the buses LP and LN, and a potential $V_M$ (charging level) at the junction of the resistors 50 and 52 is supplied to an analog input terminal D of the A/D converter 18*a*. An LCD panel 54 is connected to an output terminal E of the LCD driver of the CPU 18A. The ON/OFF signal of a light metering switch (not shown) is input as an interrupt signal to an input terminal F of the CPU 18A, and the ON/OFF signal of a release switch 55 is input to an input terminal G of the CPU 18A.

Figure 6:
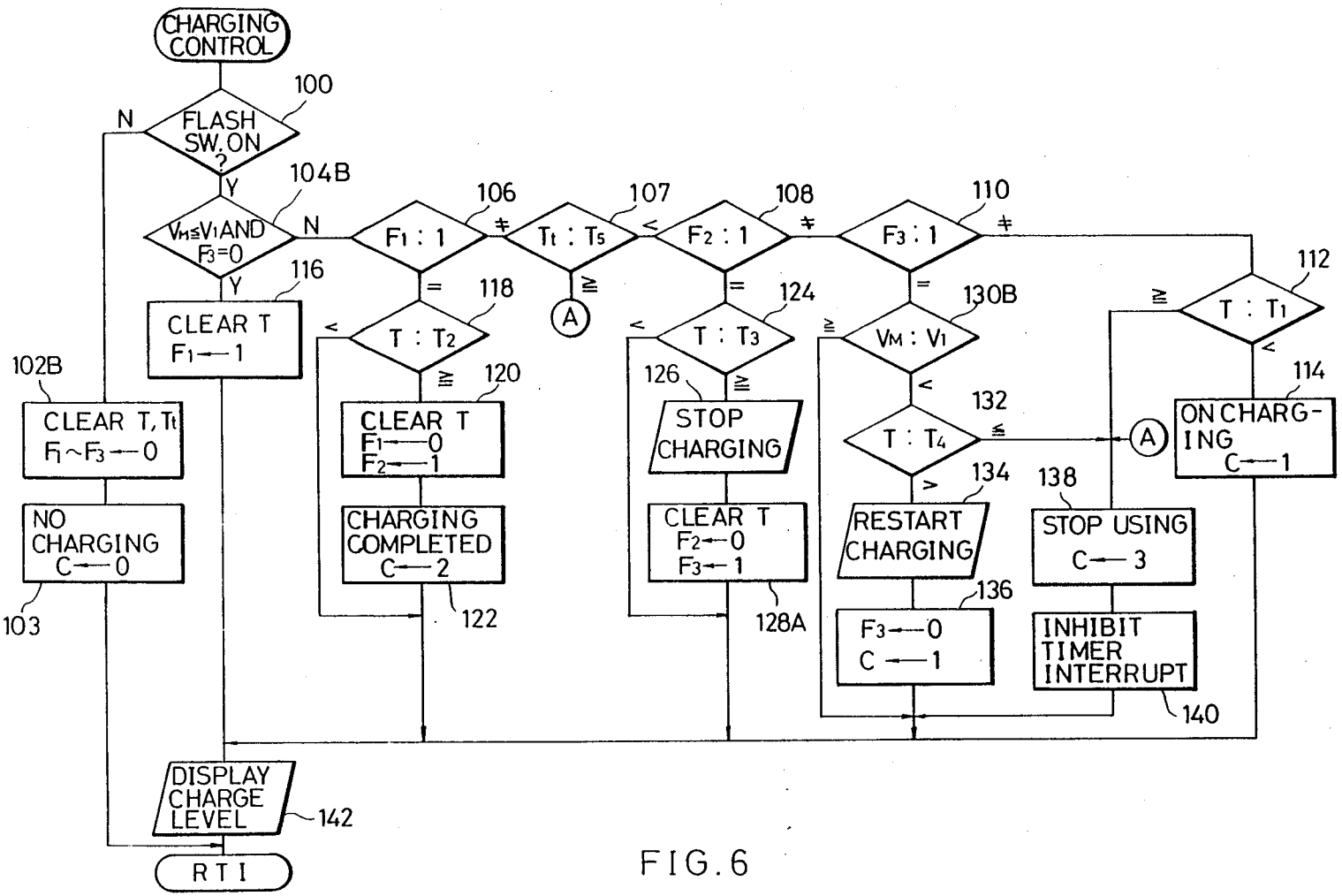
FIG. 6 is a flow chart illustrating a process sequence of the steps executed by the CPU shown in FIG. 5.

As shown in FIG. 6, in the software arrangement, Steps 102B, 104B and 130B are substituted for Steps 102A, 104 and 130 shown in FIG. 4, and Steps 107 and 142 are added.

More specifically, a timer $T_t$ is newly incorporated and, in Step 102B, the timers T and $T_t$ are cleared. Accordingly, as shown in FIG. 9, the timer $T_t$ is started immediately after the start of charging.

In Step 104B, judgement is made as to whether or not the charging level $V_M$ is higher than the level $V_1$ at which flash photography is enabled and as to whether or not the flag $F_3$ is "0".

In addition, in Step 107, inserted between Steps 106 and 108, a judgement is made as to whether $T_t>T_5$. $T_5$ is a value which is two to three times greater than, for example, $T_4$, and is allocated to allow judgement to be made as to whether or not charging is automatically stopped in order to prevent the batteries from discharging when a photographer forgets to turn off the flash switch 12. If it is judged in Step 107 that $T_t<T_5$, the process proceeds to Step 108, in which the same processing as that described previously in connection with FIG. 4 is executed. If it is judged in Step 107 that $T_t \geqq T_5$, Steps 138 and 140 are executed, and the timer interrupt is inhibited as described previously. When the light metering switch is turned on and the potential at the input terminal F of the CPU 18A reaches the high level, this inhibition is cancelled by an interrupt routine (not shown), thereby restarting the charging control.

In Step 130B, it is judged from numerical values whether, as a result of the spontaneous discharge, the charging level $V_M$ has become lower than the potential $V_1$ at which flash photography is enabled.

Moreover, in Step 142, indication bars equivalent in number to the charging level $V_M$ are displayed on the LCD panel 54 before the process returns to the processing which was executed immediately before this timer interrupt. Of the indication bars illustrated in FIG. 5, short ones correspond to the state wherein charging has not yet been completed while long ones correspond to the state wherein charging has been completed. Accordingly, a photographer can check whether or not flash photography is possible; the extent of any insufficiency in charge; or the remaining capacity of the batteries in general terms with reference to the speed at which indication bars displayed increase in number.

THIRD EMBODIMENT OF THE SECOND ASPECT OF THE INVENTION

The following is a description of a third embodiment of the second aspect of the invention.

Figure 7:
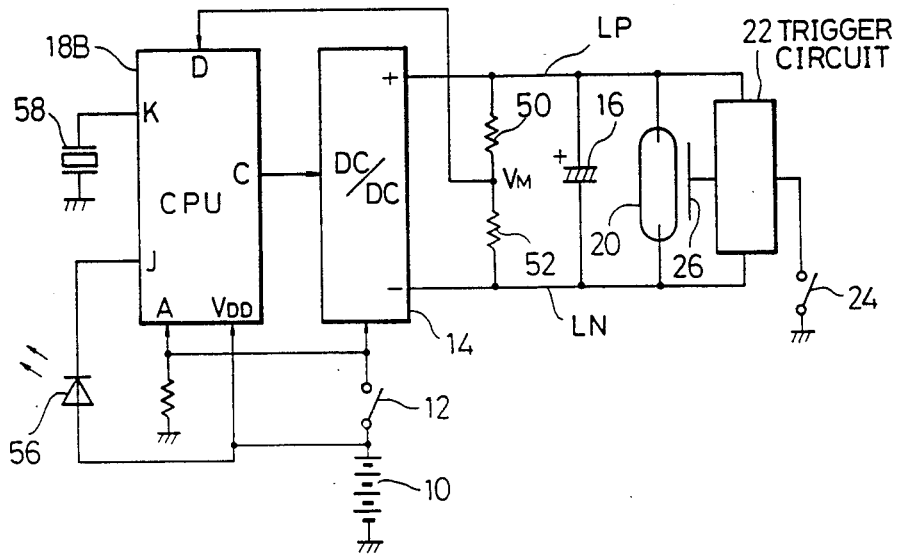
FIG. 7 is a circuit diagram of the electronic flash circuit of a third embodiment of the invention in accordance with the second aspect thereof.

The hardware arrangement of this embodiment is as shown in FIG. 7.

More specifically, instead of the LCD panel 54 shown in FIG. 5, the anode of an LED 56 is connected to the positive pole of the batteries 10 and the cathode of the LED 56 is connected to an output terminal J of a CPU 18B. One terminal of a buzzer 58 employing a piezoelectric element is connected to an output terminal K of the CPU 18B, and the other terminal of the buzzer 58 is grounded. This CPU 18B includes a signal generator whose signal output can be switched on and off by the program stored in the CPU 18B, and such signal output is provided at the output terminal K.

Although the software arrangement is not shown, in the flow chart shown in FIG. 6, the processing in Step 142 is modified as follows. More specifically, if the charging level $V_M$ is equal to or higher than the level of the reference voltage $V_1$, the level of the voltage at the output terminal J goes to the low level and the LED 56 is turned on. The signal generator is turned on and the buzzer 58 emits alarm sounds. The alarm sounds and the emission of the LED 56 inform a photographer of flash readiness. The other portion of the software arrangement is the same as that shown in FIG. 6.

EMBODIMENT OF THE THIRD ASPECT OF THE INVENTION

An embodiment of the third aspect of the invention will be described below with reference to FIGS. 10 and 11.

The hardware arrangement of this embodiment may comprise that of any of the above-described embodiments, but, by way of example, the following description is made in conjunction with the hardware arrangement illustrated in FIG. 5.

Figure 10:
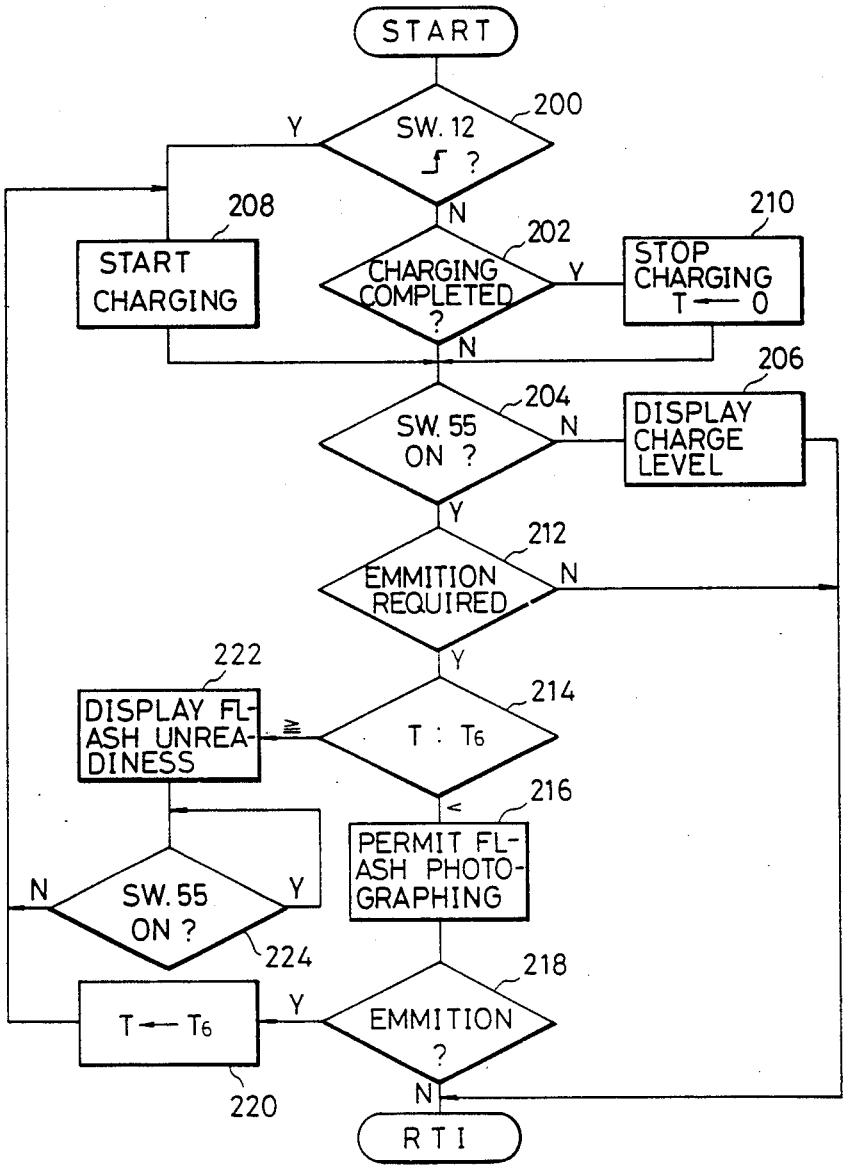
FIG. 10 is a flow chart of a process sequence of the steps executed by a CPU in the invention in accordance with the third aspect thereof.
Figure 11:
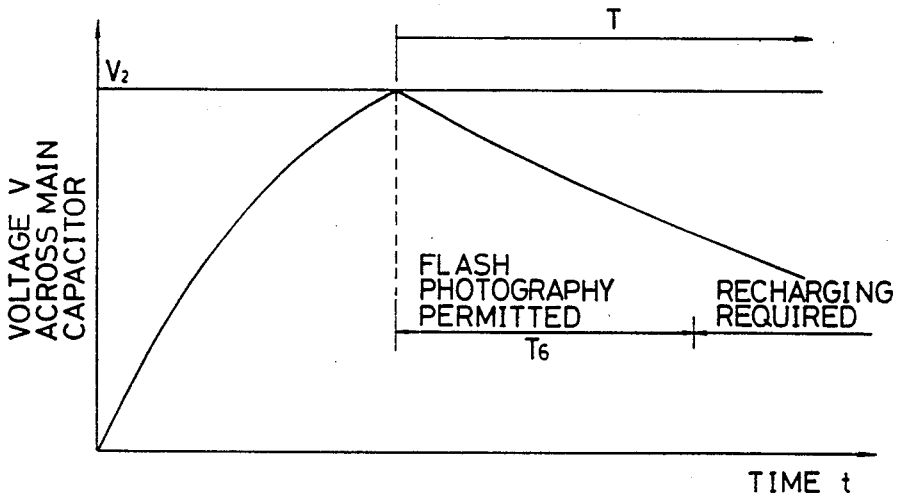
FIG. 11 is a timing chart similar to FIG. 10, illustrating the voltage V developed across the main capacitor.

The software arrangement of this embodiment is illustrated in FIG. 10. In brief, as shown in FIG. 11, when the level of the voltage V developed across the main capacitor reaches the level of the reference voltage $V_2$ ($>V_1$), charging is stopped. If the time period T which passes between the point at which charging is stopped and the point at which a release switch 55 is turned on is less than a fixed value $T_6$, flash photography is permitted. If the value of the time period T is equal to or greater than the fixed value $T_6$, charging is restarted and, after $V=V_2$ has been achieved, flash photography is enabled.

A more detailed description of this software arrangement will be described below with reference to FIG. 10.

In a manner similar to that of the previously-described embodiment, the processing of FIG. 10 is executed each time a timer interrupt for incrementing the timer T occurs.

In a case where both the flash switch 12 and the release switch 55 are OFF, after Steps 200 to 206 have been executed, the process returns to the processing which was executed immediately before this interrupt In Step 206, the level of charge is displayed as "zero".

When the flash switch 12 is turned on, the process proceeds from Step 200 to Step 208 in which charging is started, and in turn proceeds to Steps 204 and 206. Then, the process returns to the processing which was executed immediately before this interrupt. In the ensuing interrupt, Steps 200 to 206 are executed and thus the charging level to be displayed is increased. If it is judged in Step 202 that charging is completed, that is, $V=V_2$, the process proceeds to Step 210 in which charging is stopped and the timer T is cleared. The process proceeds from Step 204 to Step 206, and returns to the processing which was executed immediately before this interrupt. In the subsequent interrupt, Steps 200 to 206 are executed.

When the release switch 55 is turned on, the process proceeds from Step 204 to Step 212 in which, on the basis of the signal supplied from the main CPU (not shown), judgement is made as to whether or not the emission of the flash lamp is needed. If it is judged that the emission is not needed because of the sufficient intensity of ambient light, the process returns to the processing which was executed immediately before this interrut If it is judged that no emission is needed, the process proceeds to Step 214 in which the value of the timer T, that is, the value of time period which passes between the point at which charging is stopped and the point at which the release switch 55 is switched on is equal to or greater than the fixed value $T_6$. If it is judged that that value of the timer T is less than the fixed value $T_6$, the process proceeds to Step 216 in which a signal indicative of the permission of flash photography is supplied to the main CPU (not shown). Thus, exposure and film winding are performed. The process proceeds to Step 218 in which judgement is made as to whether a flash lamp has been flashed, that is, whether the voltage $V_M$ illustrated in FIG. 5 has reached substantial zero. If the flash lamp has been flashed, the process proceeds to Step 220, in which the value of the timer T is set to $T_6$, and then returns to Step 208, in which charging is restarted. Step 220 is provided for causing the process to proceed from Step 214 to Step 222 when the release switch 55 is turned on prior to the completion of charging. If flashing does not occur because of a failure of the flash lamp or the like, recharging is not needed. Accordingly, the process returns from Step 218 to the processing which was executed immediately before this interrupt. Subsequently, Steps 200 to 206 are executed.

If it is judged in the aforesaid Step 214 that $T \geqq T_6$, the process proceeds to Step 222 in which the LCD panel is caused to display flash unreadiness. Then, in Step 224, the process waits for the release switch 55 to be turned off, and the process returns to Step 208 in which charging is restarted. Therefore, flash photography is inhibited until charging is completed.

The initial value of the timer T is $T_6$. Accordingly, even if the release switch 55 is turned on when the flash switch 12 is OFF, the process proceeds from Step 200 through Steps 201 to 204, 212 and 214 to Step 222 in which flash photography is not permitted.

It will be readily understood by those skilled in the art that the present invention embraces various modifications and alternatives in addition to the above-described embodiments.

In each of the above-described embodiments, for the purpose of illustration, the level of the reference voltage $V_1$ is set to the voltage level at which flash photography is enabled. However, the level of the reference voltage $V_1$ may be set to a voltage level which is slightly higher than the one at which flash photography is enabled so that judgement may not need to be made as to the passage of the time period $T_2$. Alternatively, it is also possible to adopt an arrangement which allows the reference time period $T_5$ to be set by a photographer at his own discretion.

Figure 3:
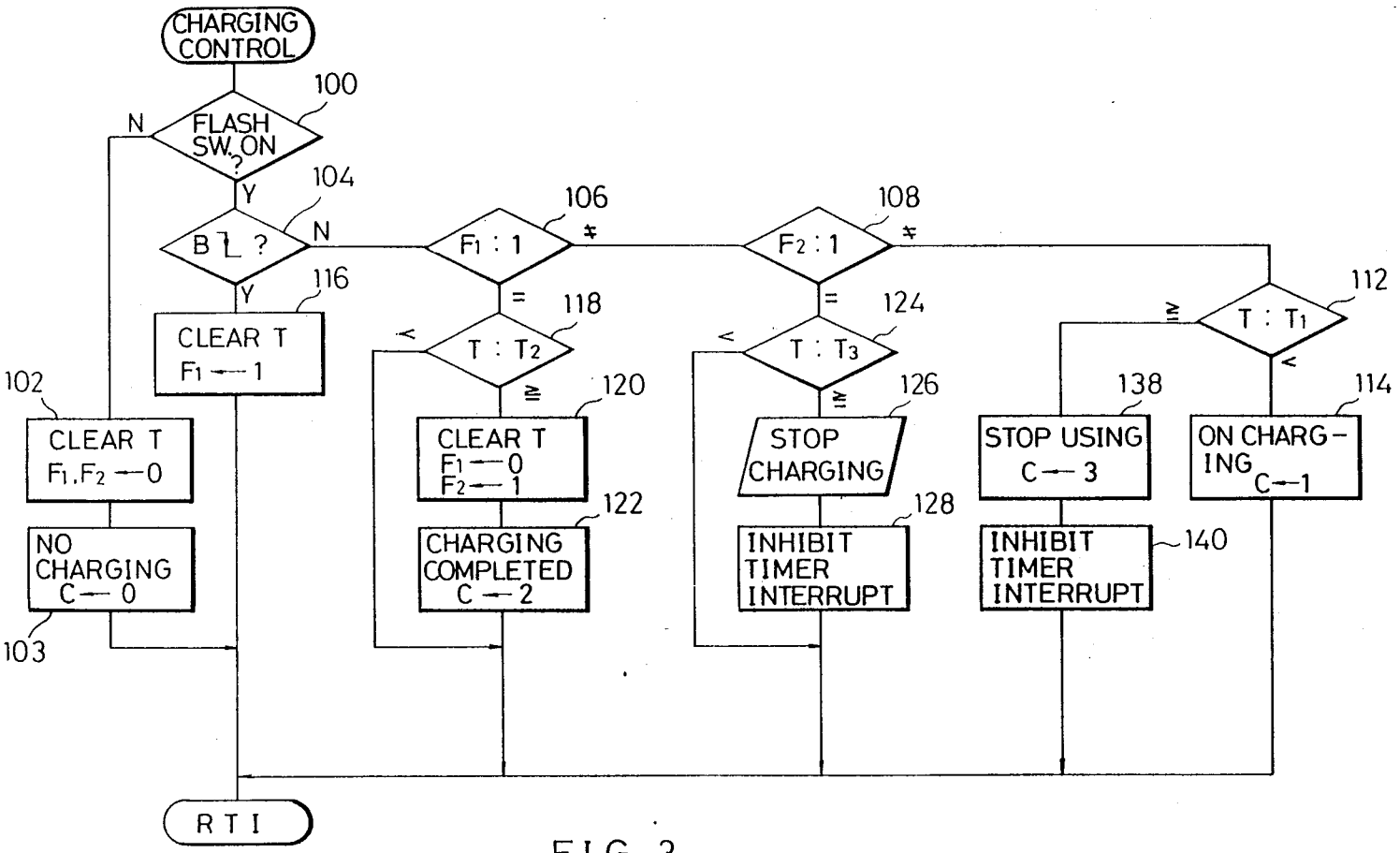
FIG. 3 is a flow chart illustrating a process sequence of the steps executed by the CPU shown in FIG. 2.
Figure 4:
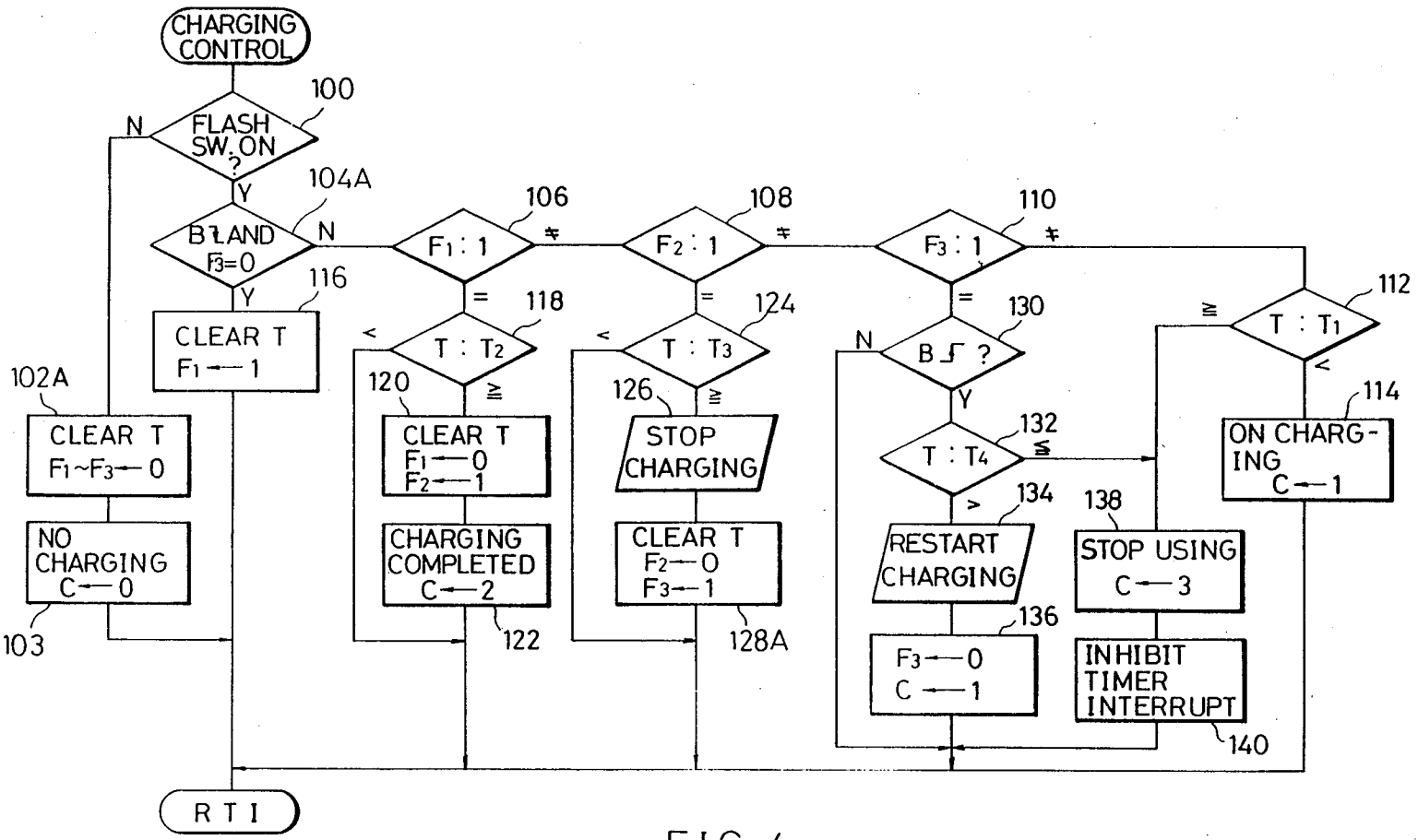
FIG. 4 is a flow chart illustrating a process sequence of the steps executed by a CPU in a preferred embodiment of the invention in accordance with the second aspect thereof.

Moreover, while the flash switch 12 is open, the CPU 18 may be arranged to output no charging command through its output terminal C and, the following Steps may be executed between Steps 100 and 104 shown in FIG. 3.

In brief, a new flag $F_4$ is added, and in Step 102 this flag $F_4$ is also reset.

(1) If the flag $F_4$ has been reset, the process proceeds to Step 104.

(2) If the flag $F_4$ has been reset a judgement is made as to whether flash photography is enabled. When it is judged that it is enabled, a charging command is outputted through the output terminal C to start charging, and then sets the flag $F_4$. Subsequently, the process proceeds to Step 104.

At this point in time, if the batteries are dead or a system switch or main switch (not shown) is OFF, it is judged that photographing is impossible. If not, it is judged that photographing is possible.

The aforesaid processing is also applicable to the flow charts shown in FIGS. 4 and 6.

Moreover, in FIG. 6, a charging frequency CN may be employed. For example, in Step 102, the charging frequency CN may be reset to "0", and the following processings may be executed between Steps 132 and 134:

(1) CN is incremented; and (2) if CN reaches a predetermined value, e.g., 2, the process proceeds to Step 138 but, if not, the process proceeds to Step 134.

What is claimed is:

1. An apparatus for controlling the charging of a main capacitor of a flash unit, comprising:

a DC/DC converter having an output voltage that is supplied to said main capacitor;

comparison means for outputting a timer start-up command when a voltage developed across said main capacitor has reached a reference voltage level at which flash photography is enabled;

a timer for outputting a charging stop command when a predetermined time period has elapsed after said main capacitor has reached said reference voltage;

control means responsive to an initial issuance of said charging stop command for disabling an oscillatory operation of said DC/DC converter to thereby stop the charging of said main capacitor, said control means being responsive to an ensuring issuance of said timer start-up command for re-starting said oscillatory operation of said DC/DC converter to restart the charging of said main capacitor; and means for displaying the level of charging of said flash unit, said display means being regulated by said control means, said charging level display corresponding to said output value of said A/D converter, wherein said timer and said control means comprise a microprocessor and said comparison means comprises a first resistor having one end connected to one end of said main capacitor, a second resistor having one end connected to the second end of said first resistor, a second end of said second resistor being connected to a second end of said main capacitor, an A/D converter for performing an analog to digital conversion of a voltage across one of said resistors, and means for outputting said timer start-up command when an output voltage of said A/D converter momentarily coincides with said reference voltage level.

2. An apparatus for controlling the charging of a main capacitor of a flash unit, comprising:

a DC/DC converter having an output voltage that is supplied to said main capacitor;

comparison means for outputting a timer start-up command by detecting when a voltage developed across said main capacitor has reached a reference voltage level at which flash photography is enabled, said DC/DC converter being disabled a predetermined period of time after the initiation of said start-up command;

a release switch for outputting a photographing command when a shutter on a camera associated with said flash unit is operated;

a timer for measuring a period of time which elapses from the reception of said timer start-up command until the reception of said photographing command;

control means arranged to permit flash photography, wherein:

(i) said flash photography is permitted if said measured time period is less than a predetermined period of time, after which the operation of said DC/DC converter is re-started so as to recharge said main capacitor; and (ii) said flash photography is inhibited if said measured time period is greater than said predetermined time period, in which case said DC/DC converter charges said main capacitor; and means for displaying the level of charging of said flash unit, said display means being regulated by said control means, said charging level display corresponding to said output value of said A/D converter, wherein said timer and said control means comprise a microprocessor, and said comparison means comprises a first resistor having one end connected to one end of said main capacitor, a second resistor having one end connected to a second end of said first resistor, a second end of said resistor being connected to a second end of said main capacitor, an A/D converter for performing an analog to digital conversion of a voltage across one of said resistors, and means for outputting said timer start-up command when an output voltage of said A/D converter momentarily coincides with said reference voltage level.

* * * * *

UNITED STATES PATENT AND TRADEMARK OFFICE

CERTIFICATE OF CORRECTION

PATENT NO. : 4,924,149

DATED : May 8, 1990

INVENTOR(S) : T. Nishida et al.

It is certified that error appears in the above-indentified patent and that said Letters Patent is hereby corrected as shown below:

At column 1, line 63, insert ---,--- after "reduced".
At column 2, line 5, insert ---,--- after "unit".
At column 2, line 24, change "$C_m$ reaches the predetermined voltage $V_2$" to ---$C_m$ reaches the predetermined voltage $V_2$---.
At column 4, line 10, before "resistor" delete "the".
At column 4, line 56, change "provides" to ---provide---.
At column 5, line 50,insert ---.--- before "The"
At column 6, line 7, insert ---,--- after "138".
At column 7, line 25, change "24" to ---42---.
At column 7, line 40, change "104" to ---104A---.
At column 9, line 10, insert ---.--- after "interrupt".
At column 9, line 34, change "interrut" to ---interrupt--
Column 9, line 34, insert —.— before "If".
At column 9, line 34, delete "no".
At column 10, line 2, change "201" to ---202---.
At column 10, line 28, insert ---,--- after "reset".

Signed and Sealed this

Thirty-first Day of January, 1995

*Attest:*

*Attesting Officer*

Bruce Lehman

BRUCE LEHMAN

*Commissioner of Patents and Trademarks*